US010253495B1

(12) United States Patent
Calini

(10) Patent No.: US 10,253,495 B1
(45) Date of Patent: Apr. 9, 2019

(54) SELF-ADJUSTING HEEL JOINT CONNECTOR AND METHOD OF SECURING A HEEL JOINT

(71) Applicant: Anthony J. Calini, Guilford, CT (US)

(72) Inventor: Anthony J. Calini, Guilford, CT (US)

( * ) Notice: Subject to any disclaimer, the term of this patent is extended or adjusted under 35 U.S.C. 154(b) by 0 days.

(21) Appl. No.: 16/040,126

(22) Filed: Jul. 19, 2018

(51) Int. Cl.
*E04B 1/38* (2006.01)
*E04B 7/04* (2006.01)
*E04B 1/26* (2006.01)

(52) U.S. Cl.
CPC ..... *E04B 7/045* (2013.01); *E04B 1/2612* (2013.01); *E04B 2001/2644* (2013.01)

(58) Field of Classification Search
CPC ..... E04B 1/2612; E04B 7/045
USPC .... 52/93.1, 93.2, 289, 655.1, 702, 712, 715; 403/232.1
See application file for complete search history.

(56) References Cited

U.S. PATENT DOCUMENTS

| | | | |
|---|---|---|---|
| 797,474 | A | 8/1905 | Walker |
| 1,657,243 | A | 1/1928 | Daniels |
| 2,354,801 | A | 8/1944 | De Huff |
| 2,477,163 | A | 7/1949 | Barnett |
| 2,611,160 | A | 9/1952 | Hanesse |
| 3,031,727 | A | 5/1962 | Nesbitt |
| 3,184,800 | A | 5/1965 | Nelson |
| 3,333,875 | A | 8/1967 | Tracy |
| 3,423,898 | A | 1/1969 | Tracy |
| 3,749,428 | A | 7/1973 | Hustead |
| 3,967,908 | A | 7/1976 | Snow |
| 4,015,399 | A | 4/1977 | Prins |
| 4,410,294 | A | 10/1983 | Gilb et al. |
| 4,414,785 | A | 11/1983 | Howell |
| 4,449,335 | A | 5/1984 | Fahey |

(Continued)

*Primary Examiner* — Joshua J Michener
*Assistant Examiner* — James J Buckle, Jr.
(74) *Attorney, Agent, or Firm* — DeLio, Peterson & Curcio, LLC; David R. Pegnataro

(57) ABSTRACT

A self-adjusting heel joint connector for securing roof structural members, without the need for a conventional birdsmouth cut or toe-nailing. The connector is slideably insertable between a bottom surface of a preset rafter and the top of a supporting wall plate at a heel joint and is capable of self-adjusting to the precise preset rafter pitch. The connector includes a framing member securable to the top of the supporting wall plate, and a support member rotatably coupled to the framing member and freely rotatable about an axis of rotation perpendicular to a longitudinal axis of the framing member. The framing member is securable to the angled rafter and an adjacent joist/tie member, as well as to the supporting wall plate, at the heel joint, and the rafter is supported by a substantially flat mating surface of the support member which extends in a direction perpendicular to a vertical leg of the framing member. The connector provides restraint from lateral movement and wind uplift, and provides for full vertical rafter load transfer partly through the framing member vertical leg of the connector and partly through the adjacent joist/tie member directly to the top of the supporting wall plate over a uniform distributed area, while transferring thrust force in the rafter to the adjacent joist/tie member. The support member further provides additional support for dead and live loads, while eliminating the need for a conventional birdsmouth cut at the heel joint.

19 Claims, 8 Drawing Sheets

(56) References Cited

U.S. PATENT DOCUMENTS

| | | | | |
|---|---|---|---|---|
| 4,669,235 | A | 6/1987 | Reinen | |
| 4,976,085 | A | 12/1990 | Krueger | |
| 5,109,646 | A | 5/1992 | Colonias et al. | |
| 5,230,198 | A | 7/1993 | Callies | |
| 5,335,469 | A | 8/1994 | Stuart | |
| 5,561,949 | A | 10/1996 | Knoth | |
| 5,572,840 | A | 11/1996 | Fast et al. | |
| 5,857,295 | A | 1/1999 | Mikawa | |
| 6,176,057 | B1 | 1/2001 | Bouchet et al. | |
| 6,295,781 | B1 | 10/2001 | Thompson | |
| 6,837,019 | B2 | 1/2005 | Collie | |
| 6,922,967 | B2 | 8/2005 | Collie | |
| 6,931,813 | B2 | 8/2005 | Collie | |
| 7,316,098 | B1 | 1/2008 | Sackett | |
| 7,707,785 | B2 | 5/2010 | Lin | |
| 7,788,873 | B2 | 9/2010 | Leek | |
| 7,891,144 | B2 | 2/2011 | Gilstrap et al. | |
| 7,918,054 | B2 | 4/2011 | Grafton et al. | |
| 7,971,410 | B2 | 7/2011 | Jerke | |
| 7,987,636 | B2 | 8/2011 | Hunt | |
| 8,590,256 | B2 | 11/2013 | Kawai et al. | |
| 8,850,774 | B2 | 10/2014 | Kempf et al. | |
| 9,175,472 | B1 | 11/2015 | Calini | |
| 2006/0059794 | A1 | 3/2006 | Gilstrap et al. | |
| 2006/0150564 | A1 | 7/2006 | Dufault | |
| 2006/0185311 | A1* | 8/2006 | Attalla ..... | E04B 7/045 52/639 |
| 2008/0244993 | A1 | 10/2008 | Crumley | |
| 2011/0225924 | A1 | 9/2011 | Carbonaro et al. | |

* cited by examiner

SELF-ADJUSTING HEEL JOINT CONNECTOR AND METHOD OF SECURING A HEEL JOINT

BACKGROUND OF THE INVENTION

1. Field of the Invention

The present invention relates to a connector for making a structural connection between a plurality of structural members joined at an angle. Specifically, the present invention relates to a self-adjusting heel joint connector for securing a roof rafter, ceiling joists/ties, and supporting walls, without the need for a conventional birdsmouth cut. The connector includes a rotatable coupling to allow for adjustment to a precise preset roof pitch for transferring vertical load through the connector directly to the top of the supporting wall plate and has the capability of transferring rafter thrust force to the joist/tie member. The framing member of the connector may further act as a guide for proper fastener placement to transfer rafter thrust force to the joist/tie member. The framing member also provides lateral restraint in each direction and restrains wind uplift. The design of the present invention forms a stable unit which provides greater lateral structural stability, while saving construction time and costs.

2. Description of Related Art

Light frame building construction is the predominant method of construction in the residential and light commercial construction market. In light frame construction, a birdsmouth joint or cut is a woodworking joint that is generally used to connect a roof rafter to the top plate of a supporting wall. It is an indentation cut into the rafter which consists of a "seat cut" (the face of which rests on the top plate) and a "heel cut" or "plumb cut" (the face of which lies parallel to the supporting wall), forming a shape resembling a bird's mouth. The indentation should not extend unsupported on the interior in order to maintain the structural integrity of the rafter because the unsupported section can split along the grain of the wood. Saw blade overrun at the birdsmouth cut can also cause damage to the rafter. The depth of a rafter cut varies according to the desired roof pitch.

The "heel" joint is generally fastened with nails by toe-nailing the rafter and joist from the side into the top plate below. Toe-nailing of the rafter and joist to the wall plate often also leads to splitting of the rafter.

Many different connectors are used in the art for joining structural members for building construction, and these different connectors are designed to secure rafters to the adjoining wall of a building structure, often at a unique angle of attachment. The connectors are typically provided with through-holes for fasteners to be driven through the connector and into the side faces of the structural members being connected. In addition, other connectors for securing a rafter to a supporting wall must be designed for withstanding upward and lateral loads developed by high winds, which can differ by geographic location, and may include hurricane forces.

The prior art has provided numerous configured connectors to secure structural members to one another, particularly in the area of rafter-joist-wall attachments; however, each has various disadvantages which impede the connector's effectiveness.

For example, U.S. Pat. No. 2,354,801 issued to De Huff on Aug. 1, 1944, entitled "RAFTER SEAT", discloses a rafter seat comprising a sheet of metal bent to form a pair of horizontally disposed spaced base plate portions for seating on the upper face of a plate structure or the like; a rafter seat portion forming a joist supporting flat surface inclined with relation to said base plate portions; and a pair of vertically extending intermediate wall portions connecting said seat portion to the respective plate portions.

De Huff's connector must be in place at the heel joint prior to placing the rafter, and therefore cannot adjust to accommodate a preset roof pitch. Further, the sloping surface is an integral part of the connector and a separate connector would have to be made for each different roof pitch. The connector also does not allow for direct full surface contact between the bottom of the rafter and the top of the supporting wall plate. There appears to be no provision for transferring rafter thrust force directly to the adjacent joist/tie to complete the structural system.

In U.S. Pat. No. 2,477,163 issued to Barnett on Jul. 26, 1949, entitled "TRUSS SHOE", a truss shoe for use with a joist and a rafter having an end face and a bottom face resting on said joist comprising a pair of parallel, spaced apart, elongated side plates of L shape and having vertical and horizontal portions and of sufficient extent to overlie parts of the side faces of said joist and said rafter; a horizontal saddle plate connecting upper edges of the horizontal portion of the side plates and extending therebetween to overlie the upper face of the joist; a second horizontal saddle plate connecting the side plates at the other end thereof and extending therebetween to overlie the upper face of the joist and coplanar with the first mentioned saddle plate; and a vertically disposed plate adjacent and above the second saddle plate and extending between and connecting the side plates to function as an abutment for the end face of the rafter, is taught.

The truss shoes may be applied and secured to opposite ends of the joist by bolts or nailing, and thereafter the rafters may be placed in position and secured by nailing to the joists. Alternatively, the truss shoes and rafters may all be assembled on the ground and then hoisted up and placed in position on the wall plates.

Barnett's design includes no lateral bracing to the wall and no connection to the wall plate, and is primarily made for a truss connection. As shown, the rafter is directly over the joist. The rafter pitch must be predetermined prior to truss fabrication, and there is no capability to adjust rafter pitch.

In U.S. Pat. No. 3,967,908 issued to Snow, et al. on Jul. 6, 1976, entitled "CROSS TIE SADDLE BRACKET", a weld fabricated steel saddle bracket having an elongated angle member with a portion thereof adapted to abut the side of the top wall plate of a building and another portion thereof adapted to lie on the top of the top wall plate and two identical right angle members having horizontal portions welded to the top portion of the elongated angle member so that the side edges thereof are in planar alignment with the side portion of the elongated member and the ends thereof lie flush with the ends of the elongated member, and the two identical right angle members having vertical portions projecting upwardly in parallel spaced apart relationship from the top surface of the top wall plate to form a saddle to receive the cross tie members and roof rafters of the building, is taught.

Snow's connector is a welded connector having no adjustable seat, and the rafter must be cut for a seat to adjust the roof pitch. There is also no provision for transferring rafter thrust force to an adjacent joist/tie member.

In U.S. Pat. No. 5,230,198 issued to Callies on Jul. 27, 1993, entitled "VARIABLE PITCH CONNECTOR", a connector for connecting a bearing member, having top, bottom, and side faces, with an inclined member having top, bottom and side faces, said connector comprising: a base having a first edge and means for connecting said base to said bearing member; a cradle member having a connection end, a free end, a bottom and a pair of sides extending upwardly at right angles from said bottom and configured to receive said inclined member, said cradle member being integrally connected at said connection end to said base along said first edge and including means for connecting said cradle to said inclined member; and a separate support member, connected to said base for supporting said cradle member, is taught.

Callies' connector must be in place prior to placing the rafter, and requires hammering to force the connector to adjust its riser seat for required pitch. Further, the connection is field bent during hammering. Callies' connector includes a separate support member which is hammered between the cradle member and the top of the supporting wall plate to adjust the pitch of the cradle member. This support member is wider than the cradle member and therefore projects on both sides of the rafter, prohibiting flush contact with an adjacent joist/tie member. Moreover, the cradle member sides also prohibit the rafter from being flush with the joist/ties, which prevents the proper fastening needed to transfer the rafter thrust load to the joist/ties. In addition, one end of the cradle member supporting the inclined member bears on the line edge of the wall plate. Building code requirements are that the load be transferred to the top of the wall plate for a minimum of 1½" bearing, which is not possible with Callies' connector.

In U.S. Pat. No. 5,335,469, issued to Stuart on Aug. 9, 1994, entitled "RAFTER TO PLATE CONNECTION", a rafter to plate connection in a wood frame building including wood top plate, and a wood rafter joined by a variable pitch connector including a rafter seat for receiving a portion of the wood rafter, a fixed base member affixed to the outside edge of the wood top plate, first and second side members joined to opposite sides of the wood rafter, and an adjustable base member joined to the rafter seat along a bend line and having a lower end in contact with the upper surface of the wood top plate, is taught. Fasteners join the fixed base member to the outside edge of the wood top plate, the adjustable base member to the wood top plate and the wood rafter to the side members.

Similar to Callies' connector, Stuart's connector must be in place prior to placing the rafter, and requires hammering to force the connector to adjust its riser seat for required pitch. Further, the connection is field bent during hammering. As in Callies, the connector first and second side members prohibit the rafter from being flush with the joist/ties, which prevents the proper fastening needed to transfer the rafter thrust load to the joist/ties. One end of the rafter seat bears on the line edge of the wall plate, which does not allow for transfer of the vertical load directly to the top of the wall plate.

The present invention overcomes the disadvantages of the prior art by providing a heel joint connector that is self-adjusting to accommodate preset rafter pitches and provides for a code-required minimum of 1½" bearing between the bottom of the rafter and the top of the supporting wall plate, while transferring vertical load through the connector directly to the top of the supporting wall plate and transferring rafter thrust force to the adjacent joist/tie member, completing the structural system. Further, the framing member of the connector is a guide for a craftsman in the field for proper placement of fasteners as required by the building code to transfer rafter thrust force to an adjacent joist/tie member, as well as vertical dead and live loads. Further, the connector provides restraint against wind uplift, as well as laterally in each direction.

Other advantages of the present invention include a reduction in the time required to fabricate each rafter, including but not limited to, handling, measuring, layout and omitting a birdsmouth cut in the rafter, as well as eliminating the need for conventional toe-nailing of the rafter to the supporting wall plate and field metal bending.

SUMMARY OF THE INVENTION

Bearing in mind the problems and deficiencies of the prior art, it is therefore an object of the present invention to provide a self-adjusting connector capable of adjoining the structural components at a heel joint in a building, including a rafter, joist/tie, and top wall plate, in a single connector and without the need for a conventional birdsmouth cut.

It is another object of the present invention to provide a self-adjusting connector which provides for transferring at least minimum code-required surface area between the bottom of a rafter and top of a supporting wall plate, without relying on a skilled craftsman to provide an accurate rafter birdsmouth cut.

It is another object of the present invention to provide a self-adjusting connector which is capable of adjusting to a precise preset rafter pitch setting from 3/12 to 12/12 for full vertical rafter load transfer through the connector directly to the top of the supporting wall plate.

A further object of the invention is to provide a self-adjusting connector which provides for increased lateral structural stability, while also providing lateral restraint in each direction and restraint against wind uplift.

It is yet another object of the present invention to provide a self-adjusting connector which reduces the time required to fabricate each rafter, including but not limited to, handling, measuring, layout and cutting a birdsmouth in the rafter, as well as eliminating the need to bevel the top of the supporting wall plate.

It is still another object of the present invention to provide a connector having a rotatable support member such that the connector need not be fabricated opposite hand, so that the layout of the rafters can butt each other at the ridge and the connector may be used on either side of the structure simply by rotating the support member.

It is still another object of the present invention to provide a self-adjusting connector which eliminates all conventional toe-nailing of the rafter to the supporting wall plate, which often leads to wood splitting at the bearing surface of the birdsmouth cut, and eliminates the requirement of field-bending and/or hammering to set the connector.

It is still another object of the present invention to provide a self-adjusting connector which is easily adaptable to repair rafters at a heel joint of an existing structure.

It is still another object of the present invention to provide a self-adjusting connector with no projecting extended sections or protrusions that would interfere with placing adjacent members flush with each other, including joist/tie members or other connectors.

It is yet another object of the present invention to provide a self-adjusting connector which may be placed on and fastened to various materials, including wood, masonry, concrete or steel, with appropriate fasteners.

Is it yet another object of the present invention to provide a connector which can serve as a guide for proper placement of fasteners per code to transfer rafter thrust force to an adjacent joist/tie member and wall plate, thus eliminating the need for proper fastener layout on each rafter.

It is still yet another object of the present invention to provide a connector that provides all of the functions noted herein from within the building structure, thus eliminating the need for scaffolding on the exterior of the structure during construction.

Still other objects and advantages of the invention will in part be obvious and will in part be apparent from the specification.

The above and other objects, which will be apparent to those skilled in the art, are achieved in the present invention which is directed to a method of securing a heel joint connecting structural members in a building roof structure. The method comprises providing a heel joint connector comprising a framing member having a substantially flat base surface adapted for securing the framing member to a top surface of a wall plate, and a vertical leg attached to or integral with the flat base surface and positioned at approximately a right angle thereto, the vertical leg adapted for securing the framing member to a rafter and an adjacent joist/tie at a heel joint, and a support member rotatably coupled to the framing member vertical leg and having a substantially flat surface portion for mating with a bottom surface of the rafter, wherein the support member is freely rotatable within a predetermined rafter pitch range about an axis of rotation perpendicular to a longitudinal axis of the framing member vertical leg. The method further comprises slideably inserting the heel joint connector between a bottom surface of a preset rafter and a top surface of a wall plate, moving the heel joint connector laterally along the wall plate top surface in the direction of an exterior stud supporting the wall plate while causing the support member to rotate to a pitch of the preset rafter until the support member flat surface portion fully contacts the rafter bottom surface, securing the connector framing member to the wall plate top surface via the framing member flat base surface, securing the connector framing member vertical leg to the rafter and an adjacent joist/tie, and securing the support member to the framing member to prevent further rotation of the support member with respect to the framing member vertical leg, thereby securing the heel joint. In an embodiment of the method, contact between the support member flat surface portion and the rafter bottom surface as the connector is moved laterally along the wall plate top surface causes the support member to rotate to the pitch of the preset rafter.

The framing member vertical leg may include a plurality of through-holes for receiving fasteners to secure the framing member to the rafter and adjacent joist/tie, wherein the plurality of through-holes are oriented in a plurality of angled row lines along the longitudinal axis of the framing member vertical leg, and the step of securing the connector framing member vertical leg to the rafter and an adjacent joist/tie may comprise driving fasteners through the framing member vertical leg plurality of through-holes into the rafter and joist/tie to secure the heel joint. Each through-hole in a row line is spaced a predetermined distance S1 along the row line, and each row line is spaced a predetermined distance S2 from each adjacent row line, wherein S1 is not equal to S2. Each through-hole in a row line is further spaced a predetermined distance S3 in a vertical dimension, wherein $S3=(S1\times\sin Ø)$, where Ø is the angle formed between the row line and a line intersecting the row line and extending parallel to a top edge of the framing member vertical leg. In an embodiment, Ø=about 33.69° (equivalent to a pitch of 8/12), and each row line is set at a pitch of 8/12. The through-hole closest to the heel joint in a bottom row line is spaced a predetermined distance S4 from a top surface of the support member flat surface portion when the support member flat surface portion is rotated to a pitch of 4/12, wherein S4 is equal to S2, and each through-hole in a row line is spaced a predetermined distance S5 from an adjacent edge of the framing member vertical leg.

The framing member flat base surface may include a plurality of through-holes for receiving fasteners to secure the framing member to a wall plate top surface, and the step of securing the connector framing member to the wall plate top surface via the framing member flat base surface may comprise driving fasteners through the framing member flat base surface plurality of through-holes into the wall plate top surface.

In an embodiment, the framing member vertical leg has no protrusions extending therefrom, and the method further comprises the steps of positioning adjacent faces of the rafter and joist/tie flush relative to the other, and driving fasteners through the framing member vertical leg plurality of through-holes into the rafter and joist/tie to secure the heel joint.

In another aspect, the present invention is further directed to a self-adjusting heel joint connector for connecting structural members in building roof structures, comprising a framing member having a substantially flat base surface adapted for securing the framing member to a top surface of a wall plate, and a vertical leg attached to or integral with the flat base surface and positioned at approximately a right angle thereto, the vertical leg adapted for securing the framing member to a rafter and an adjacent joist/tie at a heel joint; and a support member rotatably coupled to the framing member vertical leg and having a substantially flat surface portion for mating with a bottom surface of a rafter preset at a selected pitch, wherein the support member is freely rotatable about an axis of rotation perpendicular to a longitudinal axis of the framing member vertical leg.

The framing member vertical leg may include a plurality of through-holes for receiving fasteners to secure the framing member to the rafter and adjacent joist/tie, wherein the plurality of through-holes are oriented in a plurality of angled row lines along the longitudinal axis of the framing member vertical leg. Each through-hole in a row line is spaced a predetermined distance S1 along the row line, and each row line is spaced a predetermined distance S2 from each adjacent row line, wherein each row line is parallel to each adjacent row line and wherein S1 is not equal to S2. Each through-hole in a row line is further spaced a predetermined distance S3 in a vertical dimension, wherein $S3=(S1\times\sin Ø)$, where Ø is the angle formed between the row line and a line intersecting the row line and extending parallel to a top edge of the framing member vertical leg. In an embodiment, Ø=about 33.69° (equivalent to a pitch of 8/12), and each row line is set at a pitch of 8/12. The through-hole closest to the heel joint in a bottom row line is spaced a predetermined distance S4 from a top surface of the support member flat surface portion when the support member flat surface portion is rotated to a pitch of 4/12, wherein S4 is equal to S2, and each through-hole in a row line is spaced a predetermined distance S5 from an adjacent edge of the framing member vertical leg. All spacing falls within code requirements.

The framing member flat base surface may also include a plurality of through-holes for receiving fasteners to secure the framing member to a wall plate top surface.

The connector support member is self-adjustable to a preset rafter pitch, such as by slideably inserting the connector between the bottom surface of the rafter and the wall plate top surface and moving the connector laterally along the wall plate top surface in the direction of an exterior stud supporting the wall plate until the support member flat surface portion fully contacts the rafter bottom surface, wherein contact between the support member flat surface portion and the rafter bottom surface causes the support member to rotate to the pitch of the preset rafter.

The framing member vertical leg has no protrusions extending therefrom, such that the framing member vertical leg permits the rafter and adjacent joist/tie to be positioned flush relative to the other for receiving fasteners driven through the framing member vertical leg into the rafter and joist/tie to secure the heel joint.

The support member and framing member may each be fabricated from a single sheet of gage steel, formed from cast steel or formed from forged metal, and each of the framing member, support member and rotatable coupling may include a corrosion-preventing protective coating.

BRIEF DESCRIPTION OF THE DRAWINGS

The features of the invention believed to be novel and the elements characteristic of the invention are set forth with particularity in the appended claims.

The figures are for illustration purposes only and are not drawn to scale. The invention itself, however, both as to organization and method of operation, may best be understood by reference to the detailed description which follows taken in conjunction with the accompanying drawings in which.

DESCRIPTION OF THE EMBODIMENT(S)

Figure 2:
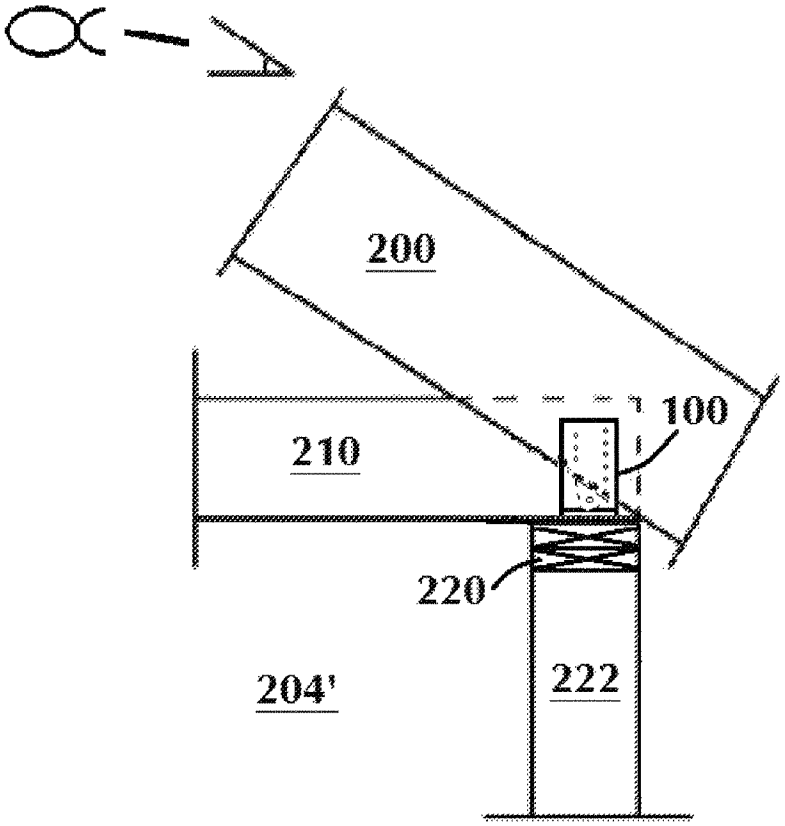
FIG. 2 depicts a heel joint including the self-adjusting heel joint connector of the present invention.

In describing the embodiments of the present invention, reference will be made herein to FIGS. 1-14 of the drawings in which like numerals refer to like features of the invention.

The present invention addresses the roof to wall heel connection in modern housing construction, more particularly wood frame construction, and specifically the roof heel joint (where the roof rafters bear on the supporting wall). It is at this connection that dead & live loads, rafter thrust force, plus wind/hurricane & seismic forces are transferred.

The joint at the intersection of the roof rafter, joist/tie, blocking, wall plate and wall studs is commonly referred to as the "heel" joint. The heel joint is one of the most significant joints in the entire building structure, and represents the point where the roof's dead and live loads with rafter thrust force are combined with wind/hurricane loads, exposing the heel joint to uplift and overturning forces in all directions. It is at this junction that the aforementioned loads are transferred to the exterior supporting, bracing and shear walls.

Conventionally, mating an angled rafter securely with the top wall plate at the heel joint is achieved using a birdsmouth cut or seat in the rafter. The standard construction is to notch the bottom of the rafter with an angular cut to accommodate the selected roof pitch and having toe-nails to connect to the top wall plate. To assure proper fit, the joint requires a skilled carpenter for accuracy to layout each rafter and to provide a cut allowing for full surface contact between the bottom of the rafter and the top of the supporting wall plate. Further, "toe-nailing" of the rafter to the supporting wall plate is required, which leads to splitting at the rafter load bearing surface. These conditions weaken the carrying capacity of the joint. Also, the birdsmouth cut reduces the cross-sectional area of the rafter. Once the rafter is positioned, the proper fastener positioning is left up to the craftsmen who would have to measure a layout on each rafter.

The present invention provides a self-adjusting heel joint connector which provides for full load transfer from the bottom of a preset rafter to the top of the supporting wall plate without the need for a conventional birdsmouth cut or "toe-nailing" of the rafter to the supporting wall plate, or the measuring of a proper fastener layout on each rafter, which are generally required in the prior art. The present invention has the capability to self-adjust to the precise preset pitch of the rafter. The design of the connector is such that the connector can provide for a pitch range of 6/12 to 12/12 (and the infinite fractions in between) for a conventional 2×4 wall plate, and 3/12 to 12/12 (and the infinite fractions in between) for a conventional 2×6 wall plate. Further, the unique design is such that the vertical rafter dead and live loads, as well as the vertical component of the thrust force, are transferred partly through the framing member vertical leg of the connector and partly through the adjacent joist/tie directly to the top of the supporting wall plate over a uniform distributed area, while the rafter thrust force is transferred to the adjacent joist/tie member, and the wind lateral and uplift load is transferred to the wall plate, providing a complete structural system.

The self-adjusting heel joint connector of the present invention includes a support member rotatably coupled to a framing member. The support member is freely rotatable with respect to the framing member about an axis perpendicular to the longitudinal axis of the framing member within a predetermined rafter pitch range, which allows the heel joint connector to self-adjust to the precise pitch of the rafter during the placing process, providing for full surface contact and direct vertical load transfer to the supporting wall plate. In one method, the heel joint connector is slidably inserted by hand between the bottom of a rafter (which has already been set in position) and the top of a supporting wall plate, and moved laterally along the top of and perpendicular to the supporting wall plate in the direction of the outside face of the supporting stud, until fully contacting both the bottom of the rafter and the top of the supporting wall plate at the preset rafter pitch.

During placement, the rafter is between a vertical leg of the framing member and an adjacent joist/tie such that the framing member vertical leg is flush with a surface of the rafter opposite the adjacent joist/tie and the rafter sits substantially flush on a top surface of the support member horizontal leg or mating surface portion. The framing and support members directly support the rafter vertical load and fasteners driven through the connector into the rafter and adjacent joist/tie member provide a single structural unit with greater lateral stability and the capability to resist and transfer rafter thrust force to the joist/tie member. The width of the support member mating surface portion may vary to accommodate the width of the rafter which is supported by the connector and joist/tie and secured to the framing member. The framing member is then secured to the top of the supporting wall plate and to the rafter and adjacent joist/tie member, respectively, using through-fasteners. The connector may be fabricated to form a single unit, with the support member rotatably secured to the framing member, such as by using a threaded bolt and nut extending through aligned apertures in the support member and framing member, respectively, or by way of a shoulder extending from the support member which is fitted within an associated bushing in the framing member, allowing the support member to freely rotate during placement. The fastener is then tightened when the connector is in proper placement and secured to prevent further rotation.

Fasteners are driven through a plurality of through-holes in the framing member vertical leg, through the rafter and into the adjacent joist/tie. All fasteners used to secure the rafter to the adjacent joist/tie member are placed perpendicular to the framing member vertical leg, which further increases the heel joint connector's load capacity. The framing member is also secured by the craftsman to the supporting wall plate using fasteners driven through a plurality of through-holes in a substantially flat base surface of the framing member. These fasteners provide stability to the connector of the present invention and provide restraint from lateral movement and uplift. Preferably, the framing member, support member, rotatable coupling, and all fasteners have a corrosion-preventing protective coating on their respective surfaces.

Certain terminology is used herein for convenience only and is not to be taken as a limitation of the invention. For example, words such as "upper," "lower," "left," "right," "horizontal," "vertical," "upward," "downward," "clockwise," and "counterclockwise" merely describe the configuration shown in the drawings. For purposes of clarity, the same reference numbers will be used in the drawings to identify similar elements.

Additionally, in the subject description, the word "exemplary" is used to mean serving as an example, instance or illustration. Any aspect or design described herein as "exemplary" is not necessarily intended to be construed as preferred or advantageous over other aspects or design. Rather, the use of the word "exemplary" is merely intended to present concepts in a concrete fashion.

Figure 1:
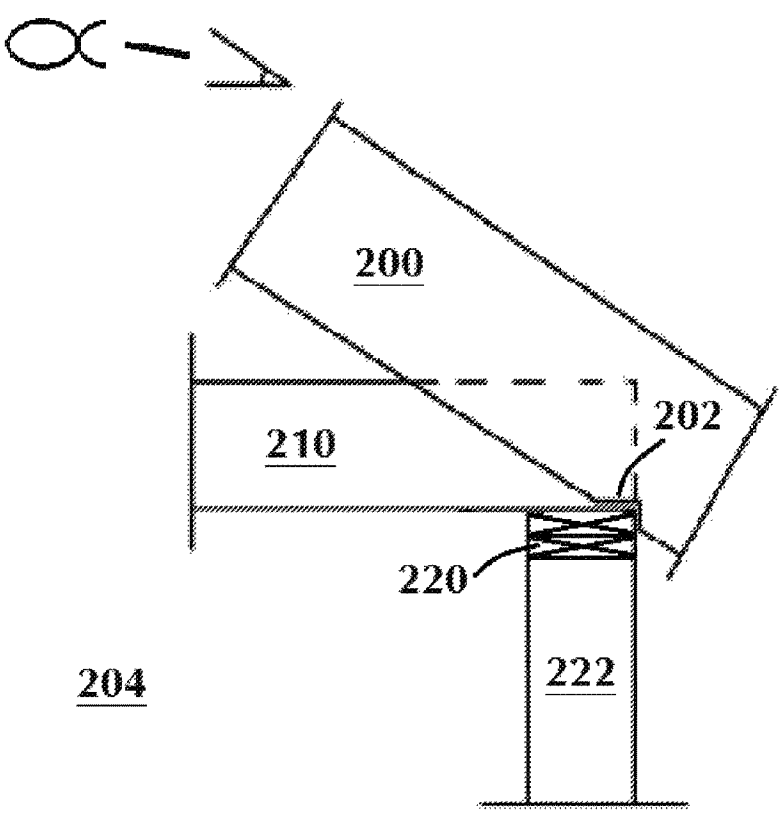
FIG. 1 (PRIOR ART)
FIG. 1 depicts a heel joint and a conventional birdsmouth cut or seat in a rafter of the prior art.

Referring now to FIG. 1, a typical heel joint 204 of the prior art is shown, with a birdsmouth cut or seat 202 in a rafter 200. Rafter 200 is positioned at angle $\alpha$ to top wall plate 220. A birdsmouth cut 202 is an "L"-shaped notch with a horizontal and vertical component sized to fit on a top wall plate 220 (shown here as a double plate), which is supported by exterior stud 222. By virtue of the birdsmouth cut, the angled rafter has significantly more than a linear contact with the top wall plate. The surface area of the weight-bearing contact (the horizontal component of the birdsmouth cut) is extended by the birdsmouth cut. Adjacent joist/tie 210 (shown behind rafter 200 for illustrative purposes) extends laterally from top wall plate 220. At each rafter-joist-exterior stud wall junction, blocking (not shown, for clarity) is also typically attached. The rafter 200 is fastened to the adjacent joist/tie member 210 using fasteners (not shown) at various locations, as determined by design and building code and set by the craftsman in the field, and "toe-nailing" of the rafter and joist/tie to the supporting wall plate 220 is typically performed.

FIG. 2 shows a heel joint 204' incorporating the self-adjusting heel joint connector 100 of the present invention. As shown in FIG. 2, and as will be more particularly described below, heel joint connector 100 is secured to the angled rafter 200 and the top of the wall plate 220, such that the bottom of the rafter is in contact with a rotatable supporting member of the self-adjusting heel joint connector, transferring the vertical load of the rafter partly through the connector and partly through the joist/tie member 210 directly to the top of the wall plate over a uniform distributed area, as well as transferring rafter thrust force to the adjacent joist/tie member, through the heel joint connector. Unlike the heel joint connectors of the prior art, no birdsmouth cut in the rafter is required.

Figure 3:
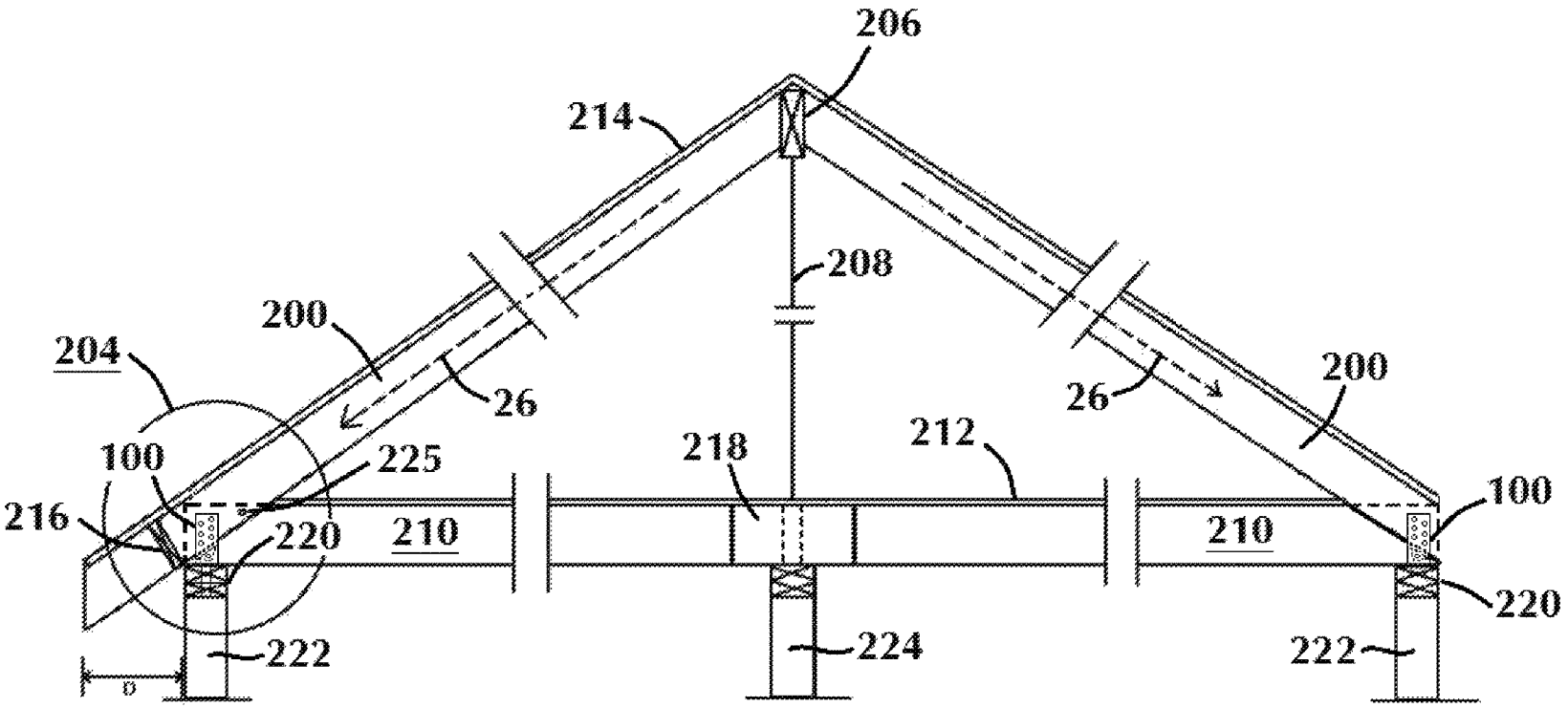
FIG. 3 depicts a conventional framing layout including the self-adjusting heel joint connector of the present invention.

FIG. 3 depicts a conventional roof framing layout, including the self-adjusting heel joint connector 100 of the present invention. For exemplary purposes, FIG. 3 depicts two conventional roof designs in one building structure. On the left half of the structure is an overhanging roof design, where rafter 200 extends beyond the exterior stud 222 by an arbitrary, predetermined distance D. Alternatively, a conventional roof framing design may be a flush mounted design, wherein the rafter does not extend beyond the exterior stud, as shown on the right half of the structure in FIG. 3. Normally, either one design or the other would be used for a single construction; however, the combination of the two simultaneously in a single structure is also possible. Other roof framing designs may also be accommodated by the connector of the present invention.

As shown in FIG. 3, rafters 200 extend at an angle from a top wall plate 220, shown here as a double plate, and are connected at an opposite end by a ridge board or beam 206. Temporary support 208 supports ridge 206. A rafter thrust force 26 emanates from the ridge 206 in the direction of the top wall plate 220, parallel to the grain of the wood rafter. Top wall plate 220 is generally supported by exterior stud 222. Adjacent joists/ties 210 extend horizontally from top wall plate 220. During placement of rafter 200, an erection fastener 225 is placed to tightly secure rafter 200 to joist/tie 210. Joist/tie 210 may be extended in length to offset splice member 218. Joist/tie 210 may further be supported by an interior partition 224, if such support is needed. Blocking 216 is supported perpendicular to the angled rafter 200 in an overhanging roof design (as in the left half of the structure), and perpendicular to the joist/tie member 210 in a flush mounted design (as in the right half of the structure), and is secured between each rafter and joist/tie. As shown in FIG. 3, flooring 212 may be installed on top of joist/tie 210, and structural roof sheathing 214 covers the rafters 200.

FIG. 3 further shows one embodiment of the self-adjusting heel joint connector 100 of the present invention, which has been slideably inserted and secured at heel joint 204. Heel joint connector 100 is designed to attach rafter 200, joist/tie 210, and top wall plate 220 in a single, self-adjusting construction design. As shown, the heel joint connector 100 has been slideably inserted and secured at the heel joint 204 between the bottom of rafter 200 and top wall plate 220 such that the vertical leg of the framing member of the connector is in the foreground of FIG. 3 and the connector is fastened to rafter 200 and adjacent joist/tie 210, which is on the far side of rafter 200. Rafters 200 abut each other at ridge 206.

As further shown in FIG. 3, a second self-adjusting heel joint connector 100 is slideably inserted and secured at the heel joint on the opposing side of the building structure, which in FIG. 3 includes a flush mounted design. The framing member of the heel joint connector of the present invention is capable of being used on the opposite side of the structure simply by rotating the support member, eliminating the need of prior heel joint connectors to be fabricated "opposite hand." As shown in FIG. 3, heel joint connector 100 is slideably inserted and secured at the opposite heel joint such that vertical leg of the framing member of the connector is in front of rafter 200 and fastened to rafter 200 and adjacent joist/tie 210, which is in the background of FIG. 3 similar to the opposing side of the structure. The rafter thrust forces 26 at each end of the building structure are transferred to the adjacent joist/tie members, which are aligned and connected by splice 218 to cancel out the opposing tension forces to complete the structural system. Whereas in a conventional framing layout of the prior art, the joist/tie members may overlap, which prevents the rafters from directly butting each other at the ridge or causes the joist/tie to not be parallel to the rafter, causing an eccentric load. Further, having the heel joint connectors directly in line on both sides of the structure and connected by a joist/tie splice member 218, as in FIG. 3, eliminates the need for permanent roof ridge supports, thus allowing for full open, unobstructed useable living space and eliminating the need for providing ridge supports to be extended down to lower supports.

Figure 4:
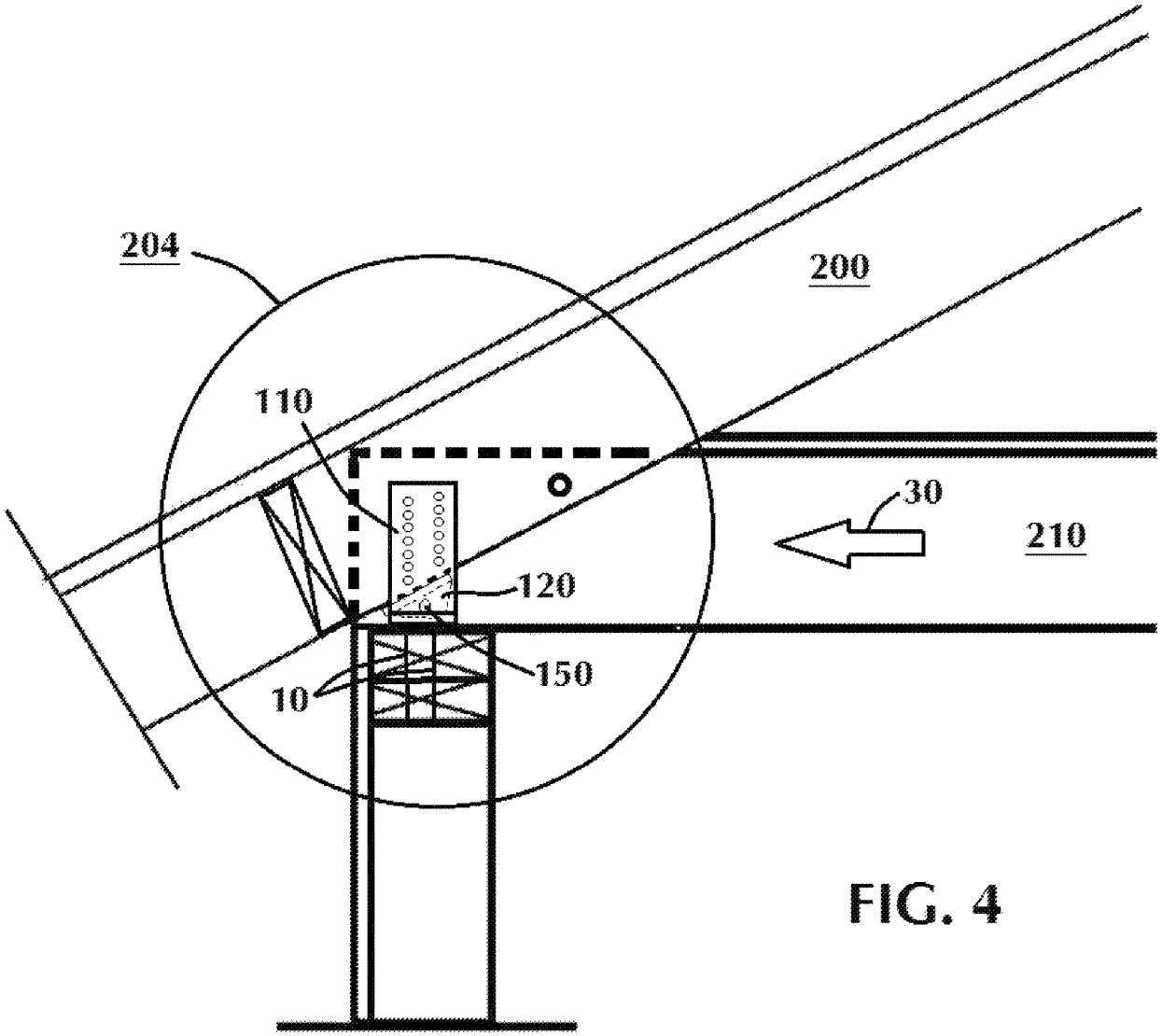
FIG. 4 depicts a magnified view of the heel joint of FIG. 3 including the self-adjusting heel joint connector of the present invention.

FIG. 4 shows a magnified view of the heel joint 204 of FIG. 3, in which the heel joint connector of the present invention has been slideably inserted and secured at heel joint 204 in the direction of arrow 30. As shown in FIG. 4, the self-adjusting heel joint connector of the present invention includes a framing member 110 having a substantially flat base surface for securing the framing member to a top surface of a supporting wall plate and a vertical leg 122, and a support member 120 rotatably secured to the framing member vertical leg and having a substantially flat mating surface portion 132 for mating with a bottom surface of the rafter 200, the flat surface portion extending in a direction substantially perpendicular to the framing member vertical leg. In the embodiment shown, framing member 110 may be secured to rafter 200 and joist 210 at a precise preset rafter pitch using fasteners (not shown) driven through a plurality of through-holes. Support member 120 is freely rotatable (prior to and during placement) and rotatably secured about a swivel joint or rotatable coupling 150 to framing member 110 secured to the top of supporting wall plate 220 using fasteners 10 driven through a plurality of through-holes (not shown). The vertical leg 122 of the framing member is flush with the surface of the rafter 200 opposite joist/tie member 210, and rafter 200 is supported from below by the support member horizontal leg or mating surface portion 132.

Figure 5:
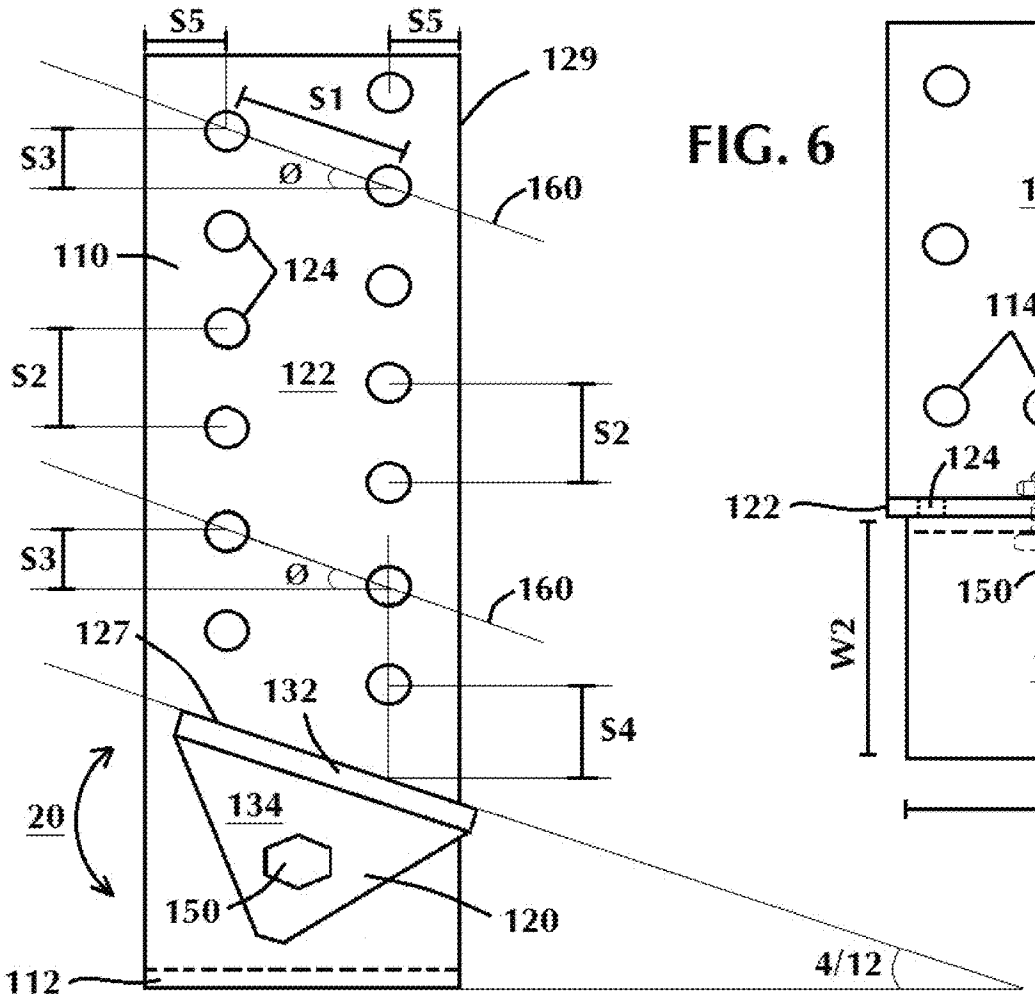
FIG. 5 depicts a front elevational view of the self-adjusting heel joint connector of FIG. 4, showing the support member in a partially rotated position to mate with a rafter at a preset pitch and the location of through-holes for proper positioning of fasteners through the framing member to the rafter and joist.

Referring now to FIGS. 5-11, collectively, an embodiment of the self-adjusting heel joint connector of the present invention is shown. FIG. 5 shows a front elevational view of one embodiment of the self-adjusting heel joint connector of the present invention. The self-adjusting heel joint connector includes a support member 120 rotatably secured to a framing member 110 about an axis of rotation 150. As shown in FIG. 5, axis 150 extends into and out of the page, perpendicular to the longitudinal axis of the framing member. The individual components of the self-adjusting heel joint connector are preferably each fabricated from a flat section of light gage metal steel, or other solid, bendable material resilient enough to attach the structural members for building construction and to withstand enhanced load forces. Alternatively, each of the support member or framing member may be fabricated from materials other than light gage steel, such as cast steel, forged metal or the like, so long as the separate components are attachable in a structurally sound manner that ultimately performs the function of the heel joint connector as claimed. The attachment of the structural members (rafter, joist/tie, and wall plate) is preferably achieved by employing fasteners, such as screws, nails, bolts and the like, driven through pre-punched through-holes in the framing member and into the face of the rafter and the top of the supporting wall plate.

Figure 6:
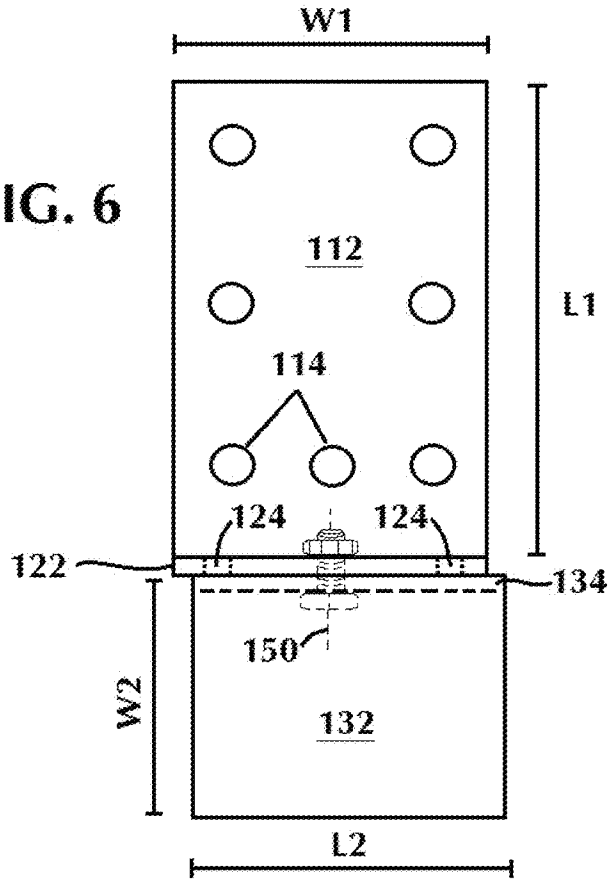
FIG. 6 depicts a top plan view of the embodiment of the self-adjusting heel joint connector of the present invention shown in FIG. 5.

As best seen in FIGS. 6-7 and 10-11, framing member 110 has a substantially flat base surface portion 112 for securing the framing member to a top surface of a supporting wall plate. In an embodiment, as shown in FIG. 6, framing member base surface 112 may have a length L1 of about 3.0" and a width W1 of about 2.0".

Figure 7:
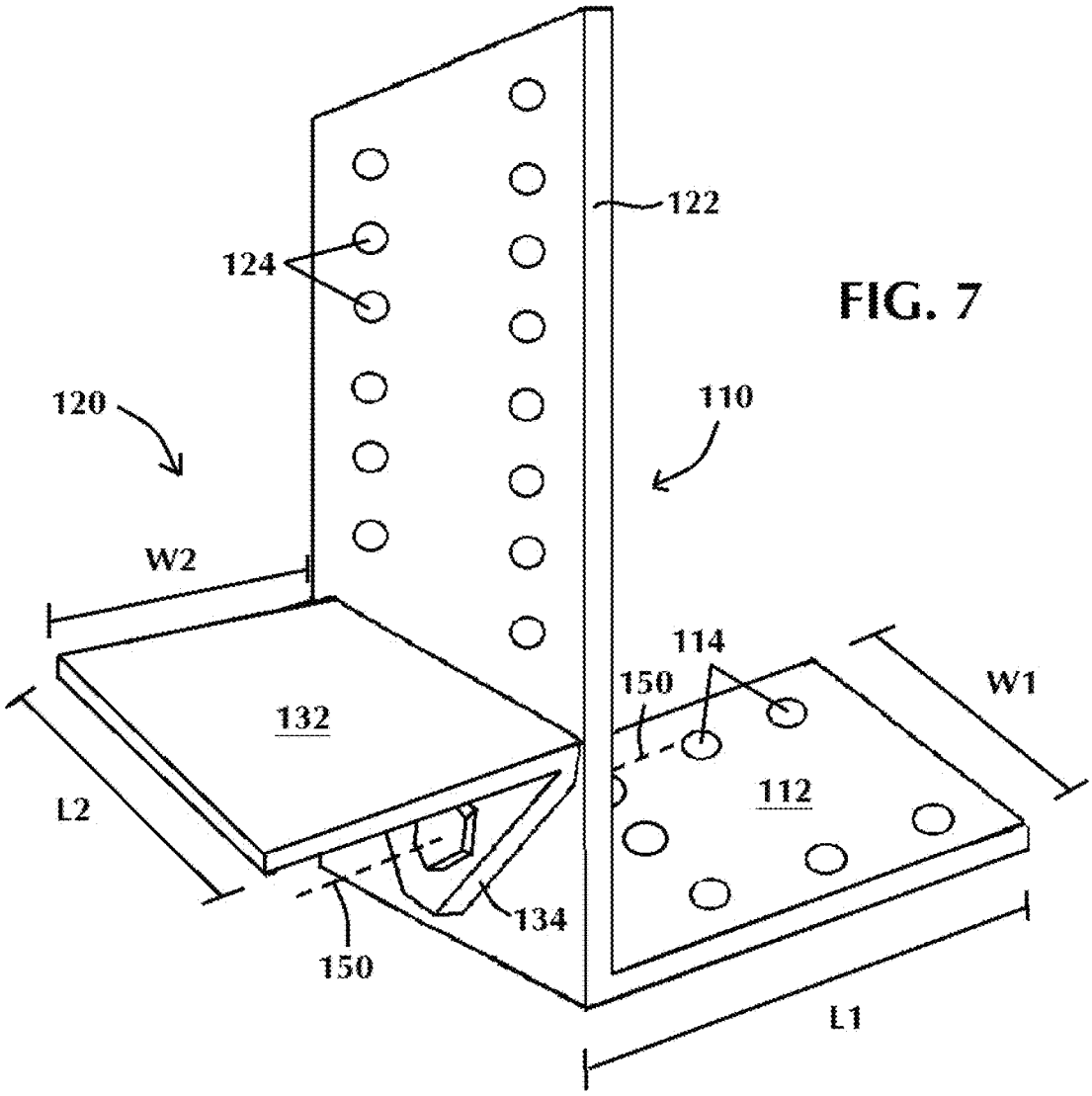
FIG. 7 depicts a perspective view of an embodiment of the self-adjusting heel joint connector of the present invention.

Referring to FIGS. 6-7, the flat base surface 112 has a plurality of through-holes 114 allowing for fasteners (not shown) to be inserted or driven therethrough to secure the framing member 110 to a supporting wall plate (not shown). The framing member may be placed and fastened to various materials, including wood, masonry, concrete, steel and the like. Preferably, the fasteners may be nails, screws, bolts or other similar fastening means, but may be any type of appropriate fastener to mate with the type of material comprising the top supporting wall plate. The number of through-holes required to secure the framing member 110 to a top surface of the supporting wall plate is shown as seven, for illustrative purposes only. Those skilled in the art should appreciate that the size, quantity and placement of fasteners (and corresponding through-holes) is design-dependent to ensure for maximum securing strength while minimizing lateral movement or racking, and the present invention is not limited to the size, number or location of through-hole placement, as shown.

Figure 8:
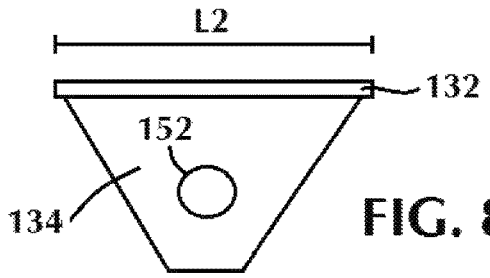
FIGS. 8-9 depict a front elevational view, and a right side cross-sectional view, respectively, of the support member of the self-adjusting heel joint connector of the present invention.
Figure 9:
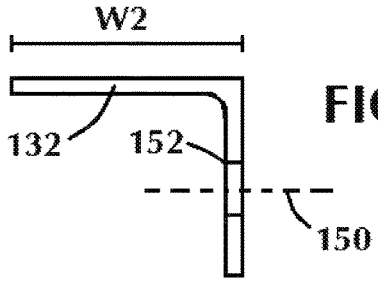
Figure 10:
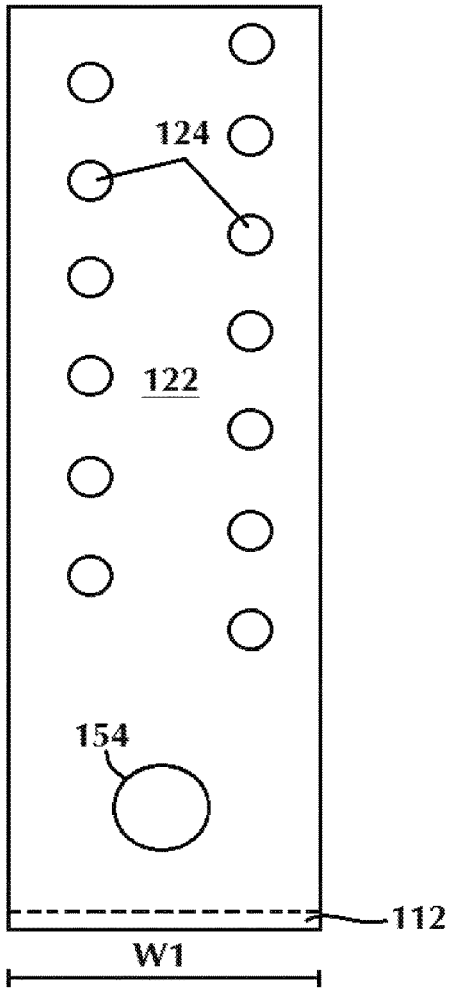
FIGS. 10-11 depict a front elevational view, and a left side cross-sectional view, respectively, of the framing member of the self-adjusting heel joint connector of the present invention.
Figure 11:
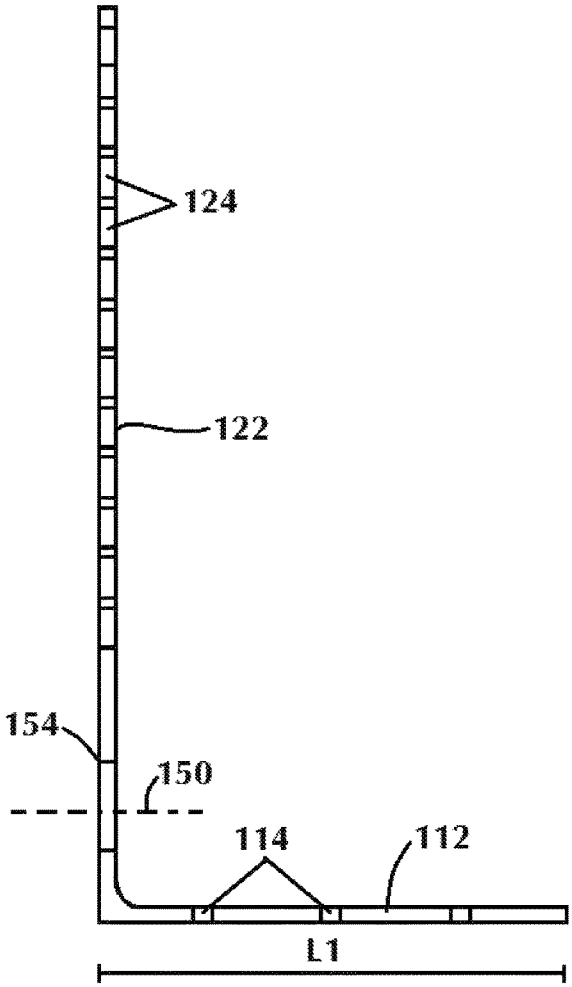

In one embodiment, as shown in FIG. 7, support member 120 has a vertical leg 134 and a flat surface portion 132, which is attached to or integral with vertical leg 134 and extends in a direction perpendicular to framing member vertical leg 122 when rotatably secured thereto about axis 150. A rafter (not shown) may be fit between the vertical leg of the framing member and adjacent joist/tie and the flat mating surface portion of the support member 120 such that the bottom of the rafter is substantially flush with and supported by the flat surface portion 132 and framing member vertical leg 122 is substantially flush with the surface of the rafter opposite an adjacent joist/tie member. As shown in FIGS. 8-9, support member flat surface portion 132 has length L2 and width W2, and the width W2 is approximately equal to the width of a 2×_, for example a conventional 2×4 or 2×6. In an embodiment, mating surface portion length L2 may be about 2.0" and width W2 may be about 1.5". The width W2 of surface portion 132 may vary in accordance with the width of the rafter(s) which it supports. Alternatively, multiple rafters may also be supported by one framing member, wherein the rafters are positioned adjacent and flush with each other. In other embodiments, support member 120 may be fabricated by casting with a threaded pin as part of the casting instead of, for example, a separate threaded bolt and nut used to rotatably secure the support member to the framing member.

Referring again to FIG. 5, support member 120 is freely rotatable about joint or axis 150 with respect to the framing member 110 in the direction of arrow 20, within a predetermined rafter pitch range. The axis of rotation 150 of support member 120 is perpendicular to the longitudinal axis of the framing member vertical leg 122. This allows the heel joint connector to self-adjust to the precise pitch of the rafter during the placing process, providing for full surface contact and load transfer. In one or more embodiments, as shown in FIGS. 5-7 and 13, joint or axis 150 comprises a rotatable coupling such as a threaded pin or bolt and nut extending through aligned apertures 152, 154 in the support member vertical leg 134 and framing member vertical leg 122, respectively, which secures the support member to the framing member and allows for rotation of the support member with respect to the framing member about an axis perpendicular to the longitudinal axis of the framing member. In other embodiments, support member 120 may include a shoulder extending therefrom which is fitted within an associated bushing in framing member 110, which allows for rotation of the support member in either direction during placement. In at least one embodiment, the axis of rotation of the support member, shown in FIGS. 5-7 and 12-13 represented by a threaded pin or bolt and nut, is positioned about 0.75" from the top of the wall plate (i.e., the bottom of the joist), and about 0.625" from the bottom of the rafter, when the connector is secured at the heel joint. The design of the heel joint connector is such that the connector can provide for a pitch range of 6/12 to 12/12 (and the infinite fractions in between) for a conventional 2×4 wall plate, and 3/12 to 12/12 (and the infinite fractions in between) for a conventional 2×6 wall plate.

As further shown in FIG. 5, framing member vertical leg 122 has a plurality of through-holes 124 allowing for fasteners to be inserted or driven therethrough to secure the framing member 110 to a rafter and an adjacent joist/tie member. The number of through-holes required to secure the framing member to the rafter and joist/tie is shown as thirteen for illustrative purposes only, as the number of fasteners (and corresponding through-holes) needed may be more or less than thirteen, based upon the rafter thrust force and vertical dead and live load. The through-holes 124 are further shown in FIG. 5 as being exaggerated in size, for clarity.

The size, placement and spacing of the fasteners is crucial for providing the full intent of the heel joint connector of the present invention, which includes allowing for the rafter thrust force and vertical dead and live load, as well as lateral loads, to be transferred to the adjacent joist/tie member, and provides for restraint against wind uplift. Presently, building codes provide information and tables stating the requirements for fastener size, layout, spacing, edge and end distance for given fastener sizes. It is then left to the craftsman in the field to interpret these requirements for each design loading condition, which leaves open the possibility of craftsman error and results in non-uniformity of positioning and spacing of fasteners and leads to splitting of the rafter, and further effects the required capacity to transfer thrust load.

To avoid this potential problem, advantageously, the self-adjusting heel joint connector of the present invention includes a plurality of through-holes which are pre-sized, pre-positioned and spaced on the framing member vertical leg so that as the connector support member rotates about the swivel joint to self-adjust to the precise preset rafter pitch during placement of the connector, the position of the through-holes (and thereafter, the location of the fasteners) will correspondingly be positioned to be perpendicular to the rafter thrust force (i.e. perpendicular to the grain of the wood) and the tension force in the joist/tie member, to allow for transfer of the thrust force to the adjacent joist/tie member when fasteners are driven therethrough. This results in a time savings in the field and, more so, prevents possible misinterpretation and layout errors by the craftsman.

The framing member of the heel joint connector thus may be used as a guide for the craftsman in the field for proper fastener placement to transfer the rafter thrust force to the joist/tie member, in accordance with building code requirements. As shown in FIG. 5, the vertical leg 122 of framing member 110 may be fabricated to include a plurality of pre-punched through-holes 124.

The size, spacing and position of each through-hole 124 are such that as the rafter pitch varies, the compression and tension forces on the fasteners remain perpendicular to the wood grain in both the rafter and the adjacent joist/tie member and the pre-designed load capacity is achieved. As shown in FIG. 5, the plurality of pre-punched through-holes 124 are oriented in a plurality of angled row lines 160 along a longitudinal axis of the framing member vertical leg 122. In an embodiment of the present invention, framing member vertical leg 122 has a height or vertical dimension of about 6.0" and a width of about 2.0". As depicted in FIG. 5, each through-hole 124 is spaced a predetermined distance S1 from the adjacent through-hole 124 in the same row line 160, and each row line is parallel to its adjacent row line(s) and angled with respect to the longitudinal axis of the vertical leg 122. Each row line 160 is spaced a predetermined distance S2 from its adjacent row line(s), wherein S1 is not equal to S2. As shown in FIG. 5, S1 is equal to about 1.44" and S2 is equal to about 0.65". The distance S3 in the vertical dimension between adjacent through-holes 124 along a row line 160 is equal to S1 multiplied by sin(Ø), where Ø represents the angle formed between row line 160 and a phantom line intersecting row line 160 and extending parallel to a top edge of vertical leg 122. In an exemplary embodiment, Ø=about 33.69° (equivalent to a pitch of 8/12), wherein each row line 160 is set at a pitch of about 8/12. As shown in FIG. 5, S3 is equal to about 0.8". As further shown in FIG. 5, the through-hole 124 closest to the heel joint (as oriented in FIG. 12) in bottom row line 160 is spaced a predetermined distance S4 from the top edge 127 of support member flat surface portion 132 when support member 120 is at a pitch of 4/12. In an embodiment of the present invention, as shown in FIG. 5, S4 is equal to S2, or about 0.65". As further shown in FIG. 5, each through-hole 124 in each row line 160 is spaced a predetermined distance S5 from the adjacent side edge 129 of vertical leg 122, such that when the connector is positioned by the craftsman in the field, the through-hole 124 that is closest to the end 211 of the joist (FIG. 12) would be in accordance with design requirements. As shown in FIG. 5, S5 is equal to about 0.4". It should be understood by those skilled in the art that distances S1 through S5 are shown with the above spacing and dimensions for exemplary purposes only for a conventional 2×4 or 2×6, and that in other embodiments the spacing and dimensions may differ depending on the dimensions of the wood frame structural members being used to form the heel joint.

Figure 12:
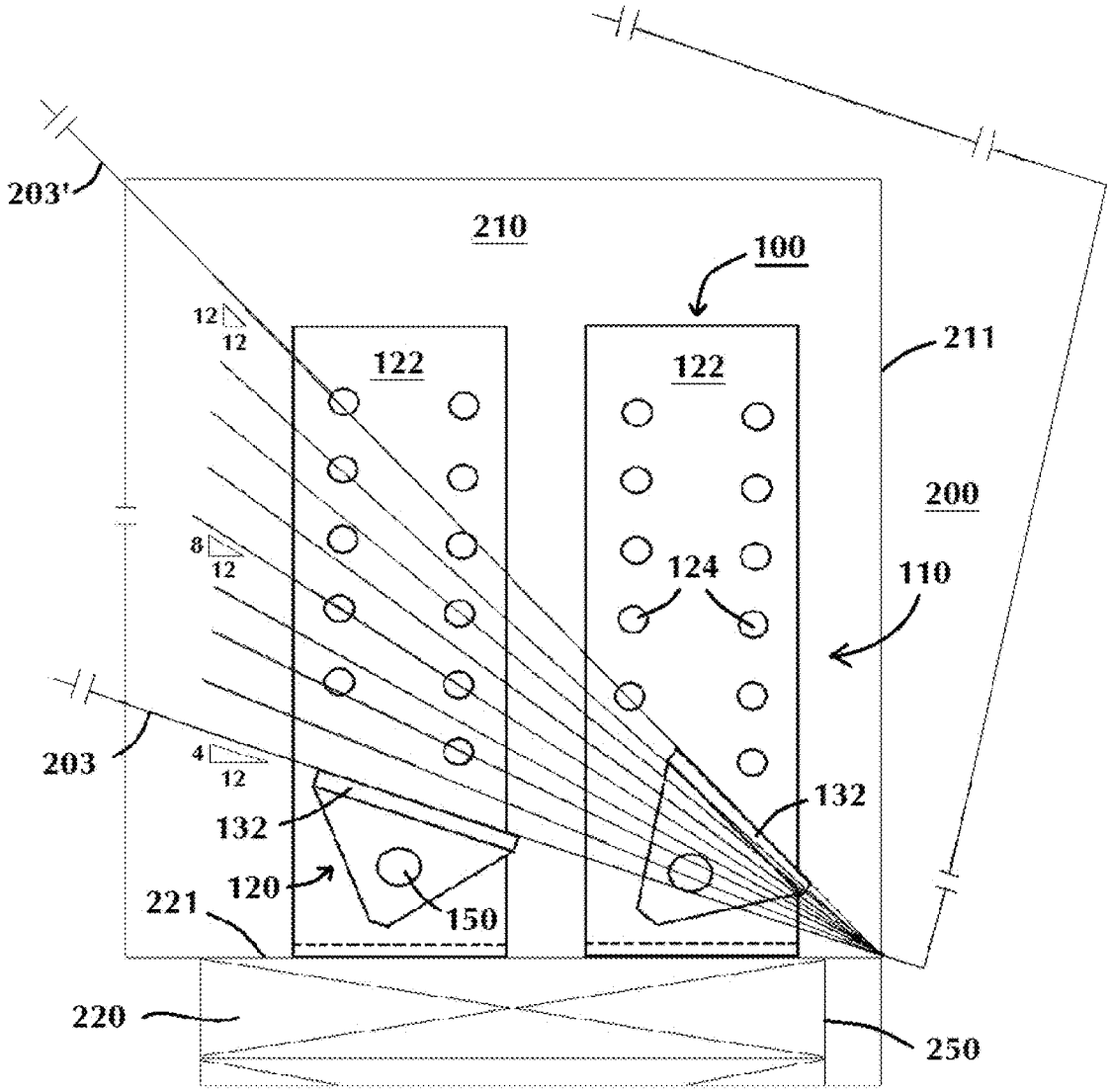
FIG. 12 depicts a side elevational view of a heel joint including the self-adjusting heel joint connector of the present invention, wherein the heel joint connector is slideably inserted between the top of the supporting wall plate and the bottom of the rafter at two different rafter pitch angles. The heel joint connector's ability to self-adjust to a precise preset rafter pitch is depicted, as well as the proper positioning of fasteners through the framing member and rafter into the adjacent joist/tie member to transfer rafter thrust force, as well as vertical dead and live load, including restraint against wind uplift and lateral wind loads in both directions.

As the framing member vertical leg 122 is positioned by the craftsman against the face 201 of the rafter at the precise preset rafter pitch (such as rafter 200 set at any pitch between 4/12 and 12/12, as shown in FIG. 12), the position of the through-holes 124 (and thereafter, the location of the fasteners) will be positioned perpendicular to the rafter thrust force 26 (i.e. perpendicular to the grain of the wood) and the tension force in the joist/tie member 210, to allow for transfer of the thrust force 26 to the adjacent joist/tie member 210 when fasteners are driven therethrough. Those skilled in the art should appreciate that the size and spacing of the through-holes will vary based upon the type and size of fastener used, as required for a range of designed load capacities.

This important interface at the heel joint (fastener size, spacing and placement) is often not given the attention that is warranted in the field by the craftsman. This is partly due to the required code interpretation for each case and the actual time required for proper layout of fasteners at each rafter. Having proper fastener size, spacing and layout designated by pre-punched through-holes in the vertical leg of the framing member is a feature unique to the self-adjusting heel joint connector of the present invention, which will prevent possible misinterpretation and layout errors by the craftsman, while allowing for transfer of the thrust force to the adjacent joist/tie member. FIG. 12 depicts a side view of a heel joint including the self-adjusting heel joint connector of the present invention, wherein a heel joint connector is slideably inserted between the top of the supporting wall plate and the bottom of the rafter at two different pitch angles. The heel joint connector's ability to self-adjust to a precise rafter pitch angle during placement is depicted. As shown in FIG. 12, joist/tie 210 is perpendicular to the top of supporting wall plate 220 and rafter 200 is preset at a selected pitch. For the connector on the left side of FIG. 12, rafter 200 is set at a pitch of 4/12, whereas for the connector on the right side of FIG. 12, rafter 200 is set at a pitch of 12/12. Heel joint connector 100 has been slideably inserted between the bottom surface 203 of rafter 200 and the top surface 221 of supporting wall plate 220, and moved laterally along the top of the supporting wall plate 220 in the direction of the outside face 250 of the exterior stud (as shown from left to right in FIG. 12) until fully contacting both the bottom surface 203 of rafter 200 and the top surface 221 of supporting wall plate 220.

Figure 13:
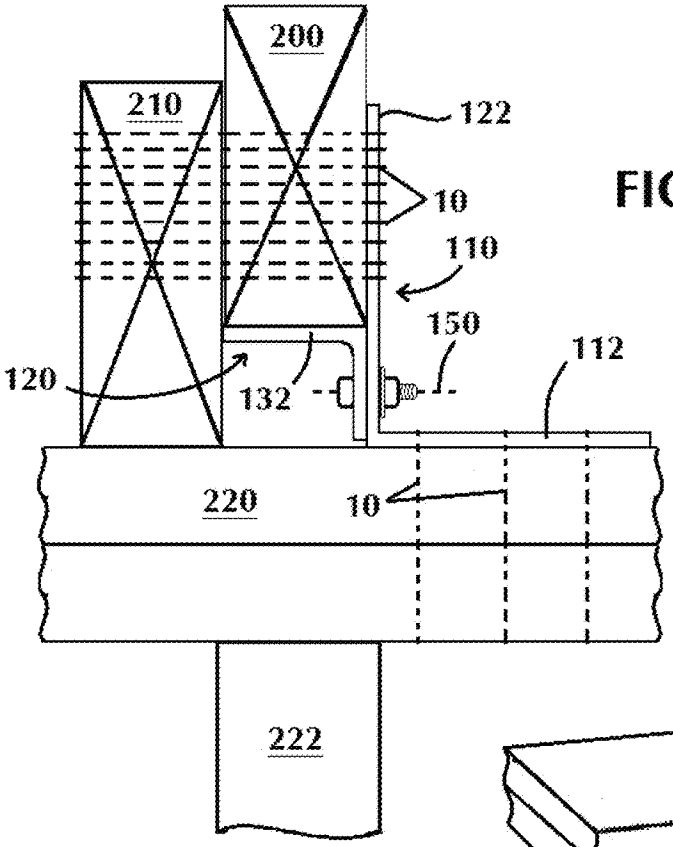
FIG. 13 depicts a cross-sectional view of a heel joint including the self-adjusting heel joint connector of the present invention.

As the support member mating surface portion 132 comes into contact with the bottom surface 203 of rafter 200 during placement, the support member 120 rotates about swivel joint or coupling 150 to self-adjust to the precise rafter pitch, enabling the bottom surface 203 of rafter 200 to remain substantially flush with the top surface of support member mating surface 132, while the framing member vertical leg 122 remains flush with the face of rafter 200. Once the connector is properly positioned at the heel joint, the connector framing member may then be secured by the craftsmen to the top surface 221 of the wall plate 220 via the framing member base surface 112 and also to the rafter 200 and adjacent joist/tie member 210 through the framing member vertical leg 122, and the rotatable coupling 150 between framing member vertical leg 122 and support member 120 may be tightened to prevent further rotation of the support member with respect to the framing member, such as by rotating a nut onto a threaded pin or bolt, as shown in FIG. 13. The flush contact between the rafter 200 and the vertical and horizontal legs 122, 132 of the connector allows for transfer of the vertical rafter load partly through the connector and partly through the joist/tie member directly to the top 221 of the supporting wall plate 220 over a uniform distributed area, while transferring the rafter thrust force 26 to the adjacent joist/tie member 210, as well as vertical dead and live loads, completing the structural system.

As further shown in FIG. 12, heel joint connector 100 is capable of self-adjusting to any precise rafter pitch. As the connector support member 120 rotates about axis 150 to self-adjust to the precise preset rafter pitch, such as adjusting between a pitch of 4/12 (bottom 203 of rafter) to a pitch of 12/12 (bottom 203' of rafter), as depicted in FIG. 12, the position of the through-holes 124 (and thereafter, the location of the fasteners) will correspondingly be positioned to be perpendicular to the rafter thrust force (i.e. perpendicular to the grain of the wood), to allow for transfer of the thrust force to the adjacent joist/tie member 210 when fasteners are driven therethrough. The heel joint connector of the present invention is shown in FIG. 12 at its two extreme positions on a conventional 2×6 wall plate, for exemplary purposes only, and it should be understood that the connector may self-adjust to accommodate any precise pre-set rafter pitch between the extreme positions.

FIG. 13 depicts a cross-sectional view of a typical heel joint including the self-adjusting heel joint connector of the present invention secured therein. As shown in FIG. 13, framing member 110 is secured to top wall plate 220 (shown here as a double plate) by way of fasteners 10 driven through a plurality of through-holes (not shown) in flat base surface 112. Support member 120 is rotatably secured to framing member 110 about axis 150, which is offset from flat base surface 112 by a predetermined distance. Framing member 110 is secured to angled rafter 200 at a preset rafter pitch by fasteners 10 inserted through properly-positioned through-holes (not shown) in framing member vertical leg 122, which is flush against the surface of rafter 200 opposite joist/tie 210. The fasteners 10 protrude through leg 122 and rafter 200 and adjacent joist/tie 210, which extends laterally above and parallel to top wall plate 220. Rafter 200 sits substantially flush against framing member vertical leg 122 and the top surface of support member mating surface 132.

Figure 14:
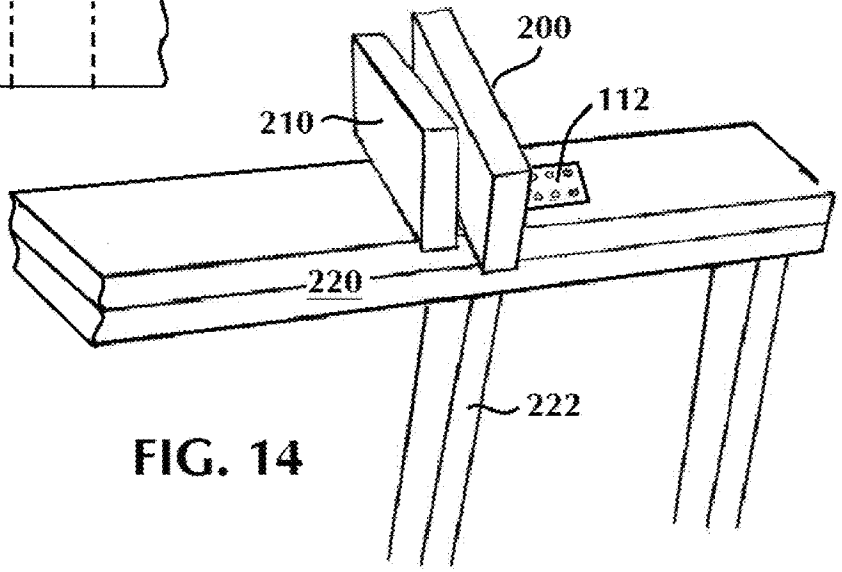
FIG. 14 depicts a perspective view of the heel joint including the self-adjusting heel joint connector of the present invention, as shown in FIG. 13.

FIG. 14 shows a perspective view of the heel joint including the self-adjusting heel joint connector of the present invention secured therein, as shown in FIG. 13. As shown in FIG. 13, and more particularly shown in FIG. 14, the connector of the present invention enables angled rafter 200 to remain flush against the surface of adjacent joist/tie 210 after placement, while transferring full vertical rafter load partly through vertical leg 122 of framing member of the connector and partly through the adjacent joist/tie member 210 directly to the top of the supporting wall plate over a uniform distributed area and providing increased lateral structural stability. In that the connector of the present invention has no protrusions or projections extending between the rafter and the adjacent joist/tie member, the connector allows the rafter 200 to be placed flush against the joist/tie member 210 for full surface contact, such that the fasteners are capable of providing full capacity for load transfer. Moreover, the flush contact between the rafter 200 and joist/tie 210 allows for complete transfer of the rafter thrust force to the joist/tie, as required to complete the structural system, as shown in FIG. 3.

The connector of the present invention is set in place by hand to its contact surfaces, and, due to the connector's ability to self-adjust to a precise preset rafter pitch, requires no hammering and field metal bending to acquire full surface contact with the bottom of the rafter and top of the supporting wall plate. Moreover, there are no marks needed to be stamped on the connector to provide the selected pitch required: it is self-setting and placed after the rafter has already been set in place by the craftsman to his selected pitch.

The present invention is adaptable to accommodate various sizes of rafters, joist/tie members, wall plates, studs and sheathing, and is not limited to any particular dimensions for these structural components. The self-adjusting heel joint connector is designed to provide a direct load path transfer through each structural member.

Due to its simplicity, size and shape, the connector of the present invention can be readily used with other connectors, such as those used for additional tie-down capacity. The present invention is further adaptable for retrofitting to existing structures and may be used to repair a heel joint of an existing construction.

Thus the present invention achieves one or more of the following advantages. The present invention provides a self-adjusting connector capable of connecting the structural components at a heel joint in a building structure, including a rafter, joist/tie, and top wall plate, in a single connector and without the need for a conventional birdsmouth cut in the rafter. The connector provides for transferring at least minimum code-required surface area between the bottom of a rafter and top of a supporting wall plate, without relying on a skilled craftsman to provide an accurate rafter birdsmouth cut, and eliminates all conventional toe-nailing of the rafter to the supporting wall plate. The connector has no projecting extended sections or protrusions that would interfere with placing adjacent members flush with each other, including joist/tie members or other connectors. The connector is capable of self-adjusting to a precise preset rafter pitch setting for full vertical rafter load transfer, restraint against wind uplift, and lateral loads in each direction, through the connector directly to the top of the supporting wall plate and provides for increased lateral structural stability. The connector further serves as a guide for proper placement of fasteners per code to transfer rafter thrust force to an adjacent joist/tie member.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of securing a heel joint connecting structural members in a building roof structure, comprising:

providing a heel joint connector comprising a framing member having a substantially flat base surface and a vertical leg, the flat base surface adapted for securing the framing member to a top surface of a wall plate, the vertical leg attached to or integral with the flat base surface and positioned at approximately a right angle thereto, the vertical leg adapted for securing the framing member to a rafter and an adjacent joist/tie at a heel joint; and a support member rotatably coupled to the framing member vertical leg and having a substantially flat surface portion for mating with a bottom surface of the rafter, wherein the support member is freely rotatable within a predetermined rafter pitch range about an axis of rotation perpendicular to a longitudinal axis of the framing member vertical leg;

slideably inserting the heel joint connector between a bottom surface of a preset rafter and a top surface of a wall plate;

moving the heel joint connector laterally along the wall plate top surface in the direction of an exterior stud supporting the wall plate while causing the support member to rotate to a pitch of the preset rafter until the support member flat surface portion fully contacts the rafter bottom surface;

securing the connector framing member to the wall plate top surface via the framing member flat base surface;

securing the connector framing member vertical leg to the rafter and an adjacent joist/tie; and securing the support member to the framing member to prevent further rotation of the support member with respect to the framing member vertical leg, thereby securing the heel joint.

2. The method of claim 1 wherein the framing member vertical leg includes a plurality of through-holes for receiving fasteners to secure the framing member to the rafter and adjacent joist/tie, the plurality of through-holes oriented in a plurality of angled row lines along the longitudinal axis of the framing member vertical leg, and wherein the step of securing the connector framing member vertical leg to the rafter and an adjacent joist/tie comprises:

driving fasteners through the framing member vertical leg plurality of through-holes and through the rafter and joist/tie.

3. The method of claim 2 wherein each through-hole in a row line is spaced a predetermined distance S1 along the row line, and each row line is spaced a predetermined distance S2 from each adjacent row line, wherein S1 is not equal to S2.

4. The method of claim 2 wherein each through-hole in a row line is spaced a predetermined distance S3 in a vertical dimension, wherein $S3=(S1\times\sin Ø)$, where Ø is an angle formed between the row line and a line intersecting the row line and extending parallel to a top edge of the framing member vertical leg.

5. The method of claim 3 wherein the through-hole closest to the heel joint in a bottom row line is spaced a predetermined distance S4 from a top surface of the support member flat surface portion when the support member flat surface portion is rotated to a pitch of 4/12, wherein S4 is equal to S2.

6. The method of claim 2 wherein each through-hole in a row line is spaced a predetermined distance S5 from an adjacent edge of the framing member vertical leg.

7. The method of claim 1 wherein contact between the support member flat surface portion and the rafter bottom surface as the connector is moved laterally along the wall plate top surface causes the support member to rotate to the pitch of the preset rafter.

8. The method of claim 1 wherein the framing member flat base surface includes a plurality of through-holes for receiving fasteners to secure the framing member to a wall plate top surface, wherein the step of securing the connector framing member to the wall plate top surface via the framing member flat base surface comprises:

driving fasteners through the framing member flat base surface plurality of through-holes into the wall plate top surface.

9. The method of claim 2 wherein the framing member vertical leg has no protrusions extending therefrom, and further comprising the steps of:

positioning adjacent faces of the rafter and joist/tie flush relative to the other; and driving fasteners through the framing member vertical leg plurality of through-holes into the rafter and joist/tie to secure the heel joint.

10. The method of claim 1 wherein the support member and framing member are each fabricated from a single sheet of gage steel, formed from cast steel or formed from forged metal, and wherein each of the framing member, support member and rotatable coupling includes a corrosion-preventing protective coating.

11. A self-adjusting heel joint connector for connecting structural members in building roof structures, comprising:

a framing member having a substantially flat base surface and a vertical leg, the flat base surface adapted for securing the framing member to a top surface of a wall plate, the vertical leg attached to or integral with the flat base surface and positioned at approximately a right angle thereto, the vertical leg including a plurality of through-holes for receiving fasteners to secure the framing member to a rafter and an adjacent joist/tie at a heel joint, the plurality of through-holes oriented in a plurality of angled row lines along a longitudinal axis of the framing member vertical leg; and a support member rotatably coupled to the framing member vertical leg and having a substantially flat surface portion for mating with a bottom surface of a rafter preset at a selected pitch, the support member freely rotatable about an axis of rotation perpendicular to the longitudinal axis of the framing member vertical leg.

12. The connector of claim 11 wherein each through-hole in a row line is spaced a predetermined distance S1 along the row line, and each row line is spaced a predetermined distance S2 from each adjacent row line, wherein S1 is not equal to S2.

13. The connector of claim 11 wherein each through-hole in a row line is spaced a predetermined distance S3 in a vertical dimension, wherein $S3=(S1\times\sin Ø)$, where Ø is an angle formed between the row line and a line intersecting the row line and extending parallel to a top edge of the framing member vertical leg.

14. The connector of claim 12 wherein the through-hole closest to the heel joint in a bottom row line is spaced a predetermined distance S4 from a top surface of the support member flat surface portion when the support member flat surface portion is rotated to a pitch of 4/12, wherein S4 is equal to S2.

15. The connector of claim 11 wherein each through-hole in a row line is spaced a predetermined distance S5 from an adjacent edge of the framing member vertical leg.

16. The connector of claim 11 wherein the support member is self-adjustable to a preset rafter pitch as the heel joint connector is slideably inserted between the bottom surface of the rafter and the wall plate top surface and moved laterally along the wall plate top surface in the direction of an exterior stud supporting the wall plate until the support member flat surface portion fully contacts the rafter bottom surface.

17. The connector of claim 11 wherein the framing member flat base surface includes a plurality of through-holes for receiving fasteners to secure the framing member to a wall plate top surface.

18. The connector of claim 11 wherein the framing member vertical leg has no protrusions extending therefrom, the framing member vertical leg permitting the rafter and adjacent joist/tie to be positioned flush relative to the other for receiving fasteners driven through the framing member vertical leg into the rafter and joist/tie to secure the heel joint.

19. The connector of claim 11 wherein the support member and framing member are each fabricated from a single sheet of gage steel, formed from cast steel or formed from forged metal, and wherein each of the framing member, support member and rotatable coupling includes a corrosion-preventing protective coating.

* * * * *